US007137420B2

(12) United States Patent
Buckman

(10) Patent No.: US 7,137,420 B2
(45) Date of Patent: Nov. 21, 2006

(54) MORTISER TOOL

(76) Inventor: Stuart Buckman, 7 Welsmere Road East Sussex, Rottingdean (GB) BN2 7DN ( * ) Notice: Subject to any disclaimer, the term of this patent is extended or adjusted under 35 U.S.C. 154(b) by 0 days.

(21) Appl. No.: 11/072,589

(22) Filed: Mar. 4, 2005

(65) Prior Publication Data

US 2005/0263212 A1 Dec. 1, 2005

(30) Foreign Application Priority Data

Mar. 4, 2004 (GB) ..... 0404956.5

(51) Int. Cl.
*B27F 5/00* (2006.01)

(52) U.S. Cl. ..... 144/69; 144/74; 144/78; 144/219; 408/24

(58) Field of Classification Search ..... 144/35.1, 144/35.2, 74, 78, 79, 69, 82, 70, 219; 408/22, 408/24, 30, 117, 118
See application file for complete search history.

(56) References Cited

U.S. PATENT DOCUMENTS 468,417 A * 2/1892 Farmer ..... 144/68
2,436,692 A * 2/1948 Greene ..... 74/57
2,622,638 A * 12/1952 Sanders ..... 144/78
2,816,583 A * 12/1957 Hill ..... 30/374
2,821,218 A * 1/1958 Hultquist ..... 144/78
2,996,090 A * 8/1961 Smith ..... 144/79
4,312,610 A * 1/1982 Burt ..... 408/26
4,412,571 A * 11/1983 Czerniewicz ..... 144/219
5,297,903 A * 3/1994 Hilton ..... 408/30
5,538,370 A * 7/1996 Glenn ..... 408/30
6,238,149 B1 * 5/2001 Hollinger et al. ..... 408/30
6,401,772 B1 * 6/2002 Beitl ..... 144/365

FOREIGN PATENT DOCUMENTS

FR 2649029 1/1991
GB 2343402 5/2000
GB 2361659 10/2001
GB 2361659 A * 10/2001

OTHER PUBLICATIONS

Copy of Search Report dated Jun. 2, 2004.

* cited by examiner

*Primary Examiner*—Bena Miller
(74) *Attorney, Agent, or Firm*—Lerner, David, Littenberg, Krumholz & Mentlik, LLP

(57) ABSTRACT

A mortiser tool comprises a drill bit, a cutting element mounted around the drill bit and a motor means. In use a motor rotates the drill bit independently of the cutting element, and in use a motor moves the drill bit in a first reciprocating action, in which the cutting element is axially movable in relation to the drill bit. The drill bit is provided with a transmission adapted to axially move the cutting element in a second reciprocating action in use, which second reciprocating action is axially non-synchronous with the first reciprocating action.

16 Claims, 1 Drawing Sheet

MORTISER TOOL

BACKGROUND OF THE INVENTION

This invention relates to a mortiser tool, for use particularly, but not exclusively as a hand-held device.

A mortiser tool which is used to create troughs, slots or openings in subject materials, for example, wood, plaster, brickwork or any other material, to receive fittings or structural components. For example such tools are used to create lock mortises on wooden doors.

One particular mortiser tool comprises a rotating drill bit, the tip of which is surrounded by a non-rotating cutting element. The end, or face, of the cutting element is commonly square, with recesses along each side, such that four points are formed by the corners. The cutting element works by being driven into the material being cut, and serves to square-off the circular hole cut by the drill bit. This kind of mortiser tool is very effective, and can cut a regular square shaped through.

Mortiser tools as described above are only used with fixed, non=portable machines, because a large force is sometimes required to force the cutting element into the subject material. Commonly the mortiser tool is vertically mounted, and a weight is used to push the tool into the subject material.

However, in many cases subject materials are cut on site, where only hand-held tools are available, for example when a new door is fitted with a lock mortise. In these circumstances the superior cutting effect if the above-described mortiser tool is not available.

The present invention is intended to overcome some of the above problems.

SUMMARY OF THE INVENTION

According to the present invention a mortiser tool comprises a drill bit, a cutting element mounted around the drill bit and motor means, in which in use the motor means rotates the drill bit independently of the cutting element, in which in use the motor means moves the drill bit in a first reciprocating action, in which the cutting element is axially movable in relation to the drill bit, in which the drill bit is provided with transmission means adapted to axially move the cutting element in a second reciprocating action in use, which second reciprocating action is axially non-synchronous with the first reciprocating action.

In a preferred construction the motor means can be a hammer drill, and the drill bit can be mounted on the hammer drill such that the first reciprocating action is the reciprocating action of the hammer drill.

The transmission means can comprise first flange means at a first end of the drill bit, and second flange means at a second end of the drill bit. The cutting element can be disposed between the first flange means and the second flange means, and the first flange means and the second flange means can be spaced apart at a distance equivalent to the length of the cutting element plus a pre-determined clearance distance. Therefore, in use when the drill bit is moved in the first reciprocating action by the hammer drill, the cutting element is struck by the first flange means and the second flange means moved axially back and forth non-synchronously with the drill bit.

In the above described arrangement the drill bit and the cutting element move back and forth non-synchronously. First the drill bit moves forward, then the first flange means hits the cutting element, moving it forward, then the drill bit moves backward, while the cutting element is moving forward, until the second flange means hits the cutting element and send it backward again. It has been found that this arrangement produces an effective cutting action.

Preferably the cutting element can comprise a sleeve, a handle extending from the sleeve, and a cutting face at the end of the sleeve. In one construction the sleeve can comprise a first body portion, from which the handle can extend in a radial direction, and a square shaped arm extending axially from the first body portion, which can have the cutting face at its end. The arm can be provided with an opening on at least one side, through which cut material can be ejected from the drill bit in use.

The first flange means can comprise a second body portion mounted on the drill bit, which can strike the first body portion in use. In a preferred construction the first and the second body portions can be cylindrical in shape. The second flange means can comprise the tip of the drill bit, which can be provided with a larger radius than the inner dimensions of a portion of the arm behind the cutting face.

The cutting face can be a square shape, in which each side is provided with a recess, such that four points are formed by the corners of the square shape. A cutting element with this type of construction at its tip is commonly referred to as a mortiser chisel, and therefore the arm of the cutting element can be a mortiser chisel of a known type. The arm can be tapered on its inner surface adjacent the cutting face, such that material cut by the four points is forced down the arm, eventually to be ejected through the opening.

In a preferred construction, the mortiser tool can be used with a motor means comprising a hand-held hammer drill, of any known type.

It will be appreciated that the above described mortiser tool includes a motor means in its construction. However the invention can also include a mortiser fitting with all the above described features, but which does not include motor means, rather it can have attachment means to attach to a motor means, preferably in the form of a hand-held drill.

Therefore, the invention also includes a mortiser fitting for a motorized drill, comprising a drill bit, a cutting element mounted around the drill bit and attachment means adapted to attach the mortiser fitting to a motorized drill, in which in use a motorized drill rotates the drill bit independently of the cutting element, in which in use the motorized drill moves the drill bit in a first reciprocating action, in which the cutting element is axially movable in relation to the drill bit, in which the drill bit is provided with transmission means adapted to axially move the cutting element in a second reciprocating action in use, which second reciprocating action is axially non-synchronous with the first reciprocating action.

Preferably, in use the mortiser fitting can be attached to a hammer drill, and the drill bit can be mounted on the hammer drill such that the first reciprocating action is the reciprocating action of the hammer drill.

The transmission means can comprise first flange means at a first end of the drill bit, and second flange means at a second end of the drill bit, and the cutting element can be disposed between the first flange means and the second flange means. The first flange means and the second flange means can be spaced apart a distance equivalent to the length of the cutting element plus a pre-determined clearance distance. Therefore, in use when the mortiser fitting is attached to a hammer drill, the drill bit is moved in the first reciprocating action by the hammer drill, and the cutting element is struck by the first flange means and the second flange means and moved axially back and forth non-synchronously with the drill bit.

BRIEF DESCRIPTION OF THE DRAWINGS

The invention can be performed in various ways, but one embodiment will now be described by way of example and with reference to the accompanying drawings in which.

DETAILED DESCRIPTION

Figure 1:
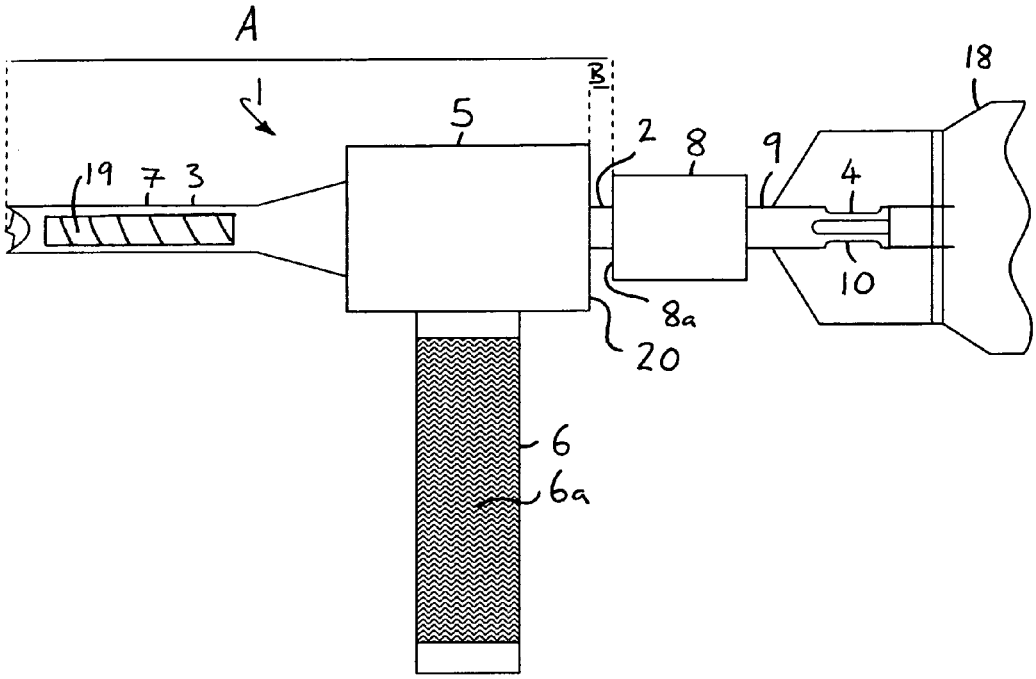
FIG. 1 is a side view of a mortiser fitting according to the present invention.

In FIG. 1 a mortiser fitting 1 for a motorized drill (not shown), comprises a drill bit 2, a cutting element 3 mounted around the drill bit 2, and attachment means 4 adapted to attach the mortiser fitting 1 to a motorized hammer drill 18. In use as described below, the motorized drill 18 rotates the drill bit 2 independently of the cutting element 3, and moves the drill bit 2 in a first reciprocating action. The cutting element 3 is axially movable in relation to the drill bit 2, and the drill bit is provided with transmission means, (in the form of body portion 8, and collar section 16, as described below), which are adapted to axially move the cutting element in a second reciprocating action in use, which second reciprocating action is axially non-synchronous with the first reciprocating action.

The cutting element 3 comprises a sleeve made up of a first cylindrical body portion 5, a handle 6 extending radially therefrom, which has a grip surface 6*a*, and an arm 7 extending axially therefrom, which is in the form of a known type of mortiser chisel. An aperture (not visible) extends through the first body portion 5 and the arm 7. An opening (also not visible) is provided along a portion of the top of the arm 7. Body portion 5 has a first bearing surface 20 and a second bearing surface 11 for contacting first and second flange means respectively.

The drill bit 2 comprises an elongate drill bit of a conventional construction, with a second cylindrical body portion 8 at its inner end 9. It is also provided with attachment means 4 in the form of indentations 10 adapted to co-operate with attachment means of the hammer drill (not shown).

Figure 2:
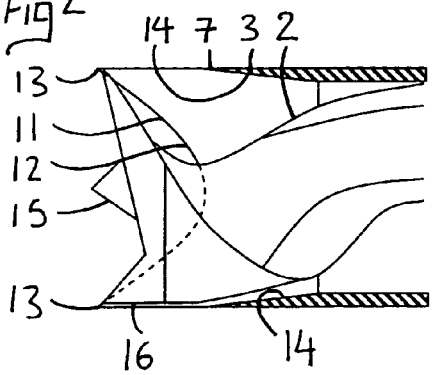
FIG. 2 is a diagrammatic view of the cutting end of the mortiser fitting as shown in FIG. 1.

(In FIG. 2 the cutting element 3 is shown in cross section and the drill bit 2 is shown in full side view. A hashed line represents the outline of the cutting face which is behind the tip of the drill bit 2.) As shown clearly in FIG. 2, the cutting face 11 of the cutting element 3 is square in shape, and each side of the square is provided with a recess 12, such that four points 13 (only two of which are visible) are formed by the corners of the square shape. The arm 7 is tapered on its inner surface 14 adjacent the cutting face 11, such that material cut by the four points 13 is forced down the arm 7, eventually to be ejected through the opening 19.

The tip 15 of the drill bit 2 comprises a collar section 16, which has a larger radius than the rest of the length of the drill bit 2, and also has a larger radius than the inner dimensions of the arm 7 beyond the tapering section, such that the drill bit 2 cannot recede into the arm 7.

As is clear in FIG. 1, the collar section 16 and the second body portion 8, (which comprises the first flange means and the second flange means of the transmission means as described above), are spaced apart by a distance A which is equivalent to the length of the cutting element 3 and a clearance distance B.

In use the drill bit 2 is connected to a hand-held hammer drill 18 by means of the attachment means 4. When the hammer drill operates, the drill bit 2 is rotated, and provided with a high-frequency reciprocal action, which forms the first reciprocating action described above. This allows the tip 15 of the drill bit 2 to cut into a subject material (not shown).

As a result of the first reciprocating action applied to the drill bit 2, and the clearance distance B, the cutting element 3 moves in a second reciprocating action which is non-synchronous with the first reciprocation action. The second body portion 8 (the first flange means 8*a*) strikes surface 20 of the first body portion 5 and moves it forward, then the drill bit 2 moves backward while the cutting element 3 is still moving forward, until the collar 16 (the second flange means) recedes into the arm 7 as far as it can go, and sends the cutting element 3 backward again. It has been found that this arrangement produces an effective cutting action.

When the tip 15 of the drill bit 2 cuts into the subject material, it creates a round hole, and the cut material is sent up the arm 7 and out of the opening (not shown). When the cutting face 11 of the cutting element 3 is driven forward, the points 13 cut around the round hole created by the drill bit 2, and square it off. The pieces of the subject material carved off by the points 13 are forced by the tapering section up into the arm 7, where they are also ejected from the opening (not visible).

In an alternative embodiment (not shown) the mortiser fitting 1 is permanently attached to a hammer drill, and there is no attachment means 4. With this arrangement a single mortiser tool according to the invention is created.

It will be appreciated that the mortiser fitting 1 (or a mortiser tool as described above) can be altered without departing from the spirit of the invention. For example, in one alternative embodiment (not shown) the arm 7 can be removable from the first body portion 5. The arm 7 can be provided with a sleeve which fits into the aperture through the first body portion 5, and which can be held in place by means of a grub screw mounted in an aperture in the first body portion 5. Further, the second body portion 8 and the inner end 9 of the drill bit 2 can be removed from the rest of the drill bit 2 by means of a similar arrangement. With this set-up, the cutting part of the drill bit 2 and the arm 7 can be removed from the rest of the components and replaced with equivalent parts of a smaller or larger size, as desired.

In addition, in one further alternative embodiment (not shown) the drill bit 2 can be mounted inside the cutting element by means of a bearing structure to improve performance.

Thus a mortiser tool is provided which can be used with a hand-held drill, and with effectively creates a square hole by operating a drill bit and mortiser chisel in a new and inventive manner.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A mortiser tool comprising a reciprocating drill bit, a cutting element mounted around the drill bit and motor means, wherein the motor means rotates the drill bit independently of the cutting element, and simultaneously moves the drill bit in a first reciprocating action, in which the cutting element is axially movable in relation to the drill bit, in which the drill bit is provided with transmission means adapted to axially move the cutting element in a second reciprocating action in use, which the second reciprocating action is non-synchronous with the first reciprocating action.

2. A mortiser tool as claimed in claim 1 in which the motor means is a hammer drill, and the drill bit is mounted on the hammer drill such that the first reciprocating action is the reciprocating action of the hammer drill.

3. A mortiser tool as claimed in claim 2 in which the transmission means comprises a first flange means at a first end of the drill bit, and a second flange means at a second end of the drill bit, in which the cutting element is provided with a first bearing surface adjacent the first flange means and a second bearing surface adjacent the second flange means, in which the first flange means and the second flange means are spaced apart a distance equivalent to the distance between the first and second bearing surface and a clearance distance, such that, in use, when the drill bit is moved in the first reciprocating action by the hammer drill, the first bearing surface of the cutting element is struck by the first flange means and the second bearing surface is struck by the second flange means such that the cutting element is moved axially back and forth non-synchronously with the drill bit.

4. A mortiser tool as claimed in claim 3 in which the cutting element comprises a sleeve, a handle extending radially from the sleeve, and a cutting face at a first end of the sleeve.

5. A mortiser tool as claimed in claim 4 in which the sleeve comprises a first body portion, from which the handle extends, and a square shaped arm extending axially from the first weight portion, and which has the cutting face at its end.

6. A mortiser tool as claimed in claim 5 in which the arm has an opening on at least one side, through which cut material can be ejected from the drill bit in use.

7. A mortiser tool as claimed in claim 6 in which the first flange means comprises a second body portion mounted on the drill bit.

8. A mortiser tool as claimed in claim 7 in which the second flange means comprises a tip of the drill bit, and in which the tip of the drill bit is provided with a larger radius than the inner dimensions of a portion of the arm behind the cutting face.

9. A mortiser tool as claimed in claim 8 in which the first body portion and the second body portion are cylindrical in shape.

10. A mortiser tool as claimed in claim 4 in which the cutting face is a square shape, in which each side is provided with a recess, such that four points are formed by the corners of the square shape.

11. A mortiser tool as claimed in claim 10 in which the arm is tapered on its inner surface adjacent the cutting face, such that material cut by the four points is forced down the arm, eventually to be ejected through the opening.

12. A mortiser tool as claimed in claim 2 in which the hammer drill is a hand-held hammer drill.

13. A mortiser fitting for a motorized drill, comprising a drill bit, a cutting element mounted around the drill bit and attachment means adapted to attach the mortiser fitting to a motorized drill, wherein the motorized drill rotates the drill bit independently from the cutting element, and the motorized drill simultaneously moves the drill bit in a first reciprocating action, in which the cutting element is axially movable in relation to the drill bit, in which the drill bit is provided with transmission means adapted to axially move the cutting element in a second reciprocating action in use, which the second reciprocating action is axially non-synchronous with the first reciprocating action.

14. A mortiser fitting as claimed in claim 13 in which the motorized drill is a hammer drill, and the drill bit is mounted on the hammer drill such that the first reciprocating action is the reciprocating action of the hammer drill.

15. A mortiser fitting as claimed in claim 14 in which the transmission means comprises first flange means at a first end of the drill bit, and second flange means at a second end of the drill bit, in which the cutting element is provided with a first bearing surface adjacent the first flange means and a second bearing surface adjacent the second flange means, in which the first flange means and the second flange means are spaced apart a distance equivalent to the distance between the first and second bearing surface and a clearance distance, such that, in use, when the drill bit is moved in the first reciprocating action by the hammer drill, the first bearing surface of the cutting element is struck by the first flange means and the second bearing surface is struck by the second flange means such that the cutting element and moved axially back and forth non-synchronously with the drill bit.

16. A mortiser tool comprising:

a rotary drill having a first end for boring a hole in a workpiece and a second end axially spaced from said first end;

an actuator having a clamping part for receiving the second end of said drill, said actuator simultaneously rotating said drill about an axis and moving said drill axially back and forth in both directions with respect to said axis, said drill having a first bearing surface adjacent the first drill end and a second bearing surface adjacent the second end of said drill; and a chisel surrounding said drill having at least two spaced parallel cutting surfaces extending parallel to said axis, said chisel rotationally fixed and axially moveable with respect to said drill, said chisel having first and second bearing surfaces for respectively engaging the first and second bearing surfaces of said drill, said first and second drill bearing surfaces spaced along said axis a distance greater than said chisel first and second bearing surfaces; such that said chisel moves with respect to said axis in a non-synchronous axial movement with said drill for at least part of said back and forth movement of said drill along said axis.

* * * * *